US006186964B1

(12) United States Patent
Branham

(10) Patent No.: US 6,186,964 B1
(45) Date of Patent: Feb. 13, 2001

(54) HYDRO-MASSAGE PILLOW SYSTEM

(76) Inventor: Tony J. Branham, P.O. Box 2509, Gig Harbor, WA (US) 98335-2509

( * ) Notice: Under 35 U.S.C. 154(b), the term of this patent shall be extended for 0 days.

(21) Appl. No.: 08/938,235

(22) Filed: Sep. 26, 1997

Related U.S. Application Data

(60) Provisional application No. 60/026,793, filed on Sep. 27, 1996.

(51) Int. Cl.[7] ..... A61H 9/00

(52) U.S. Cl. ..... 601/148; 601/155; 4/541.6

(58) Field of Search ..... 601/155, 167, 601/168, 169, 148, 15, 88, 154, 156–160, 76, 77, 55, 56, 96, 105; 4/541.1, 541.2, 541.3, 541.4, 541.5, 541.6, 492, 575.1; 5/670, 671, 672; 239/36–44, 56, 57; 401/207

(56) References Cited

U.S. PATENT DOCUMENTS

| | | | | |
|---|---|---|---|---|
| 893,021 | * | 7/1908 | Siebert, Jr. | 4/541.1 |
| 3,720,204 | * | 3/1973 | Wojtowicz | 601/148 |
| 3,924,808 | * | 12/1975 | Cooley, Jr. | 239/97 |
| 4,635,619 | * | 1/1987 | Diamond | 601/148 |
| 4,640,462 | * | 2/1987 | Stearns, III | 239/383 |
| 4,805,664 | * | 2/1989 | Mattie et al. | 239/570 |
| 4,839,930 | * | 6/1989 | Watkins | 4/546 |
| 4,926,510 | | 5/1990 | Watkins | 4/542 |
| 5,003,646 | * | 4/1991 | Stamp et al. | 4/542 |
| 5,241,953 | * | 9/1993 | Sykes | 61/165 |
| 5,245,714 | * | 9/1993 | Haraga et al. | 601/167 |
| 5,392,472 | * | 2/1995 | Maxfield | 4/507 |
| 5,503,618 | | 4/1996 | Rey | 601/15 |
| 5,540,651 | * | 7/1996 | Risch et al. | 601/148 |
| 5,546,616 | * | 8/1996 | Bloemer et al. | 4/541.2 |
| 5,716,333 | * | 2/1998 | Larsen | 601/148 |
| 5,820,574 | * | 10/1998 | Henkin et al. | 601/160 |

* cited by examiner

*Primary Examiner*—Justine R. Yu
(74) *Attorney, Agent, or Firm*—E. Russell Tarleton; Seed IP Law Group PLLC

(57) ABSTRACT

A hydro-massage pillow assembly (10) including a pillow assembly (12) in combination with a water source (18) and a control assembly (14) for use with spa tubs (16) and the like. The pillow assembly (12) includes interchangeable membrane assemblies (44, 46), that are made of material with different permeability. The cushioned, flexible pillow (34) conforms to the shape of the tub (16) to enhance appearance and comfort. A remote control head (26) permits users to conveniently control the temperature, pressure, and other desired control parameters of the massaging effect produced by the pressurized water in the pillow assembly (12).

11 Claims, 3 Drawing Sheets

HYDRO-MASSAGE PILLOW SYSTEM

This application claims the benefit of U.S. Provisional Application No. 60/026,793, filed Sep. 27, 1996.

TECHNICAL FIELD

The present invention relates to cushioned neck and head supports for whirlpool baths and spa tubs and, more particularly, to a hydro-massage pillow system having internally mounted water jets for application of pressurized water to a user's neck area to achieve a massaging effect.

BACKGROUND OF THE INVENTION

Users of whirlpool baths and spa tubs (referred to collectively herein as "tub(s)") frequently desire to recline while in the tub. Pillows have been provided in the past to support and cushion the user's neck and suboccipital area when reclining. It has been found desirable to use water jets with such pillows to massage the user's neck as well as provide support and comfort. Although existing combinations have been suitable for their purposes, they have met with several drawbacks.

Water jets mounted in pillows tend to spray the pressurized water across the tub, resulting in unwanted splashing of water both inside and outside the tub. Attempts to cover the water jets have been marginally successful because the water is either completely blocked, so that the benefits of the heated water are reduced, or a residual water spray remains.

Other drawbacks include inadequate or overly complex attachment methods for mounting the pillow to the tub, and expensive and cumbersome control systems, or lack of any control.

SUMMARY OF THE INVENTION

The present invention is directed to a water massage device that includes a housing having a hollow interior; a pressurized water source for introducing pressurized water to the hollow interior; a membrane removably attached to the housing and in fluid communication with the hollow interior; and a retaining member for removably attaching the membrane to the housing. Ideally, the pressurized water source also includes means for draining water from the hollow interior.

In accordance with another aspect of the present invention, the retaining member for removably attaching the membrane to the housing is received in an opening formed in the housing, the opening being sized and shaped to receive the retaining member in slideable engagement.

In accordance with yet another embodiment, the membrane is formed from nonpermeable material. Alternatively, the membrane may be formed from semipermeable material.

In accordance with a further aspect of the present invention, a hydro-massage pillow for use with a source of pressurized water is provided. The pillow comprises a body having a cavity formed therein; a first opening formed in one side of the body that is in fluid communication with the cavity for admitting pressurized water into the cavity; a second opening formed in another side of the body that is in fluid communication with the cavity; a membrane that is sized and shaped to cover at least a portion of the second opening; and a frame member for removably attaching the membrane to the body.

In accordance with another aspect of the present invention, the frame member is sized and shaped to be slideably received within the second opening. Ideally, the frame member is sized and shaped to have a fit within the second opening of sufficient snugness that the frame member and the membrane maintain engagement with the body when pressurized water is applied in the cavity.

In accordance with yet a further aspect of the present invention, the second opening includes one or more protrusions extending from an interior edge to limit travel of the frame member into the second opening. Ideally, the one or more protrusions comprise a shoulder formed in the second opening, preferably extending around the entire circumference of the opening.

In accordance with still yet another aspect of the present invention, the membrane is formed of semipermeable material. Alternatively, the membrane may be formed from nonpermeable material and the body includes a drain mechanism for draining water from the cavity.

In accordance with a further aspect of the present invention, an apparatus for mounting the pillow on a structural member is provided. Preferably, the mounting apparatus attaches one or more water jets to the pillow and affixes the pillow to a structural member.

In accordance with yet a further aspect of the present invention, a hydro-massage support system for whirlpool baths and spa tubs is provided, comprising a support assembly that comprises a body having a cavity formed therein; a first opening formed in the body in fluid communication with the cavity for admitting pressurized water into the cavity; a second opening formed in the body in fluid communication with the cavity; a membrane sized and shaped to cover at least a portion of the second opening; a frame member on which the membrane is mounted, the frame member being sized and shaped to be slideably engaged within the second opening; a control assembly for controlling the application of pressurized water to the cavity; and a remote controller in electrical communication with the control assembly.

In accordance with a further aspect of the present invention, the second end opening includes one or more protrusions formed therein for limiting the travel of the frame member into the second opening. Ideally, the one or more protrusions comprise a shoulder formed at least partially, and more preferably, completely around the circumference of an interior edge of the second opening.

In accordance with still yet a further aspect of the present invention, the membrane is formed from semipermeable material. Alternatively, the membrane is formed from nonpermeable material and the body includes a drainage mechanism for draining the cavity.

As will be readily appreciated from the foregoing description, the combination of the present invention provides a unique system for using pressurized water in a cushioned pillow. Membranes of different permeability can be easily interchanged to provide different massaging effects. Mounting of the pillow on a structural member, such as a hot tub, is easily accomplished, and forming the pillow body from flexible material allows the pillow to conform to the shape of the tub to enhance appearance and comfort. The remote control enables a user to conveniently adjust the temperature, pressure, and other desired system features.

BRIEF DESCRIPTION OF THE DRAWINGS

The foregoing and other advantages of the present invention will be more readily appreciated as the same become better understood from the detailed description when taken in conjunction with the following drawings, where.

DETAILED DESCRIPTION OF THE INVENTION

Figure 1:
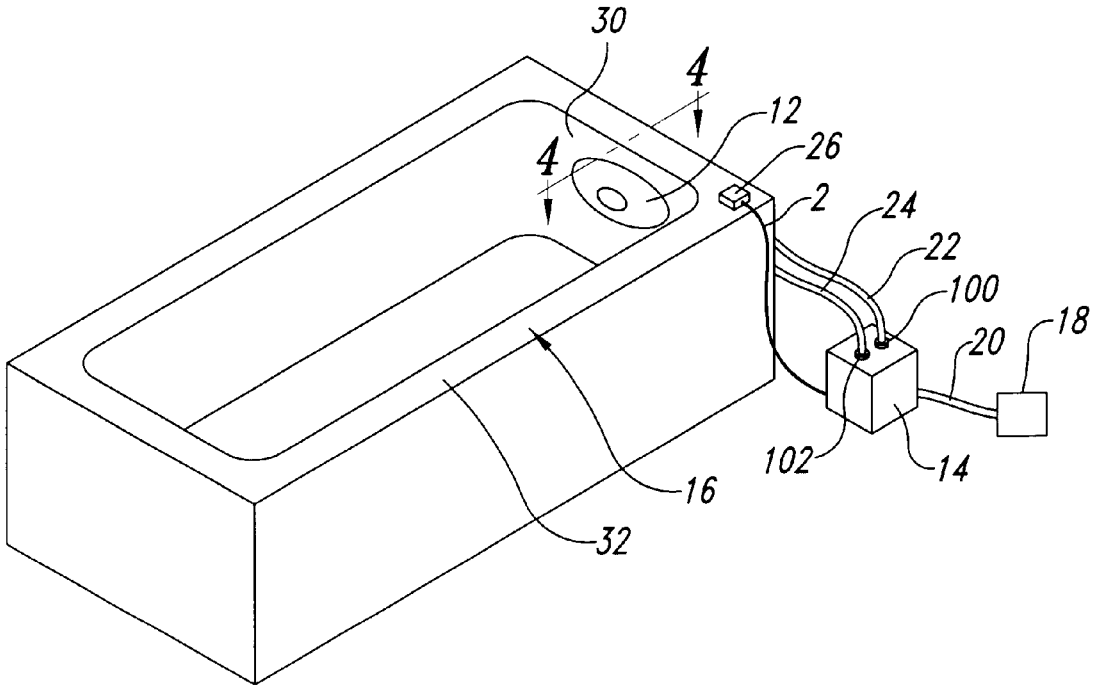
FIG. 1 is an isometric view of a hydro-massage pillow system formed in accordance with the present invention.

Referring initially to FIG. 1, illustrated therein are the components of a hydro-massage pillow system 10 formed in accordance with the present invention. The hydro-massage pillow system 10 includes a pillow assembly 12 in fluid communication with a control assembly 14 used in conjunction with a spa tub 16. A water source 18 provides water to the control assembly 14 through a source hose 20, and the water in turn is supplied to the pillow assembly 12 via supply hoses 22, 24. An electric control head 26 communicates control signals to the control assembly 14 through a cable 28. It is to be understood that while the system 10 of the present invention is described in conjunction with a spa tub as shown in FIG. 1, the invention may be readily adapted for use with other types of tubs, including whirlpool baths, and the like.

The pillow assembly 12 shown in FIG. 1 is mounted on the end wall 30 of the tub 16. Preferably, the pillow assembly 12 is positioned above the water line, and the control head 26 is mounted on the deck 32 of the tub 16, again above the water level and preferably above the head of the user. Commercially-available fasteners and conventional attachment methods can be used for mounting the pillow assembly 12 and the control head 26 to the tub 16. Briefly, holes are drilled in the end wall 30 to enable fasteners (not shown) to pass therethrough and attach to the pillow assembly 12. Additional holes are drilled that are sized and shaped to accommodate fittings for the hoses 22, 24, as will be described in more detail hereinafter. Preferably, the hose fittings on the back of the pillow assembly 12 are used to attach the pillow assembly 12 to the end wall 30, as will be described more fully hereinbelow.

Figure 2:
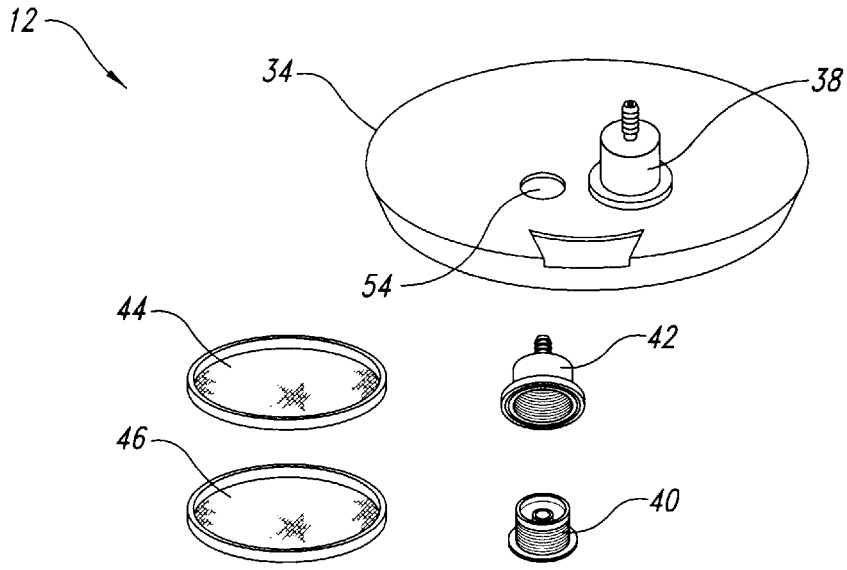
FIG. 2 is a rear isometric view of the disassembled components of the hydro-massage pillow formed in accordance with the present invention.
Figure 3:
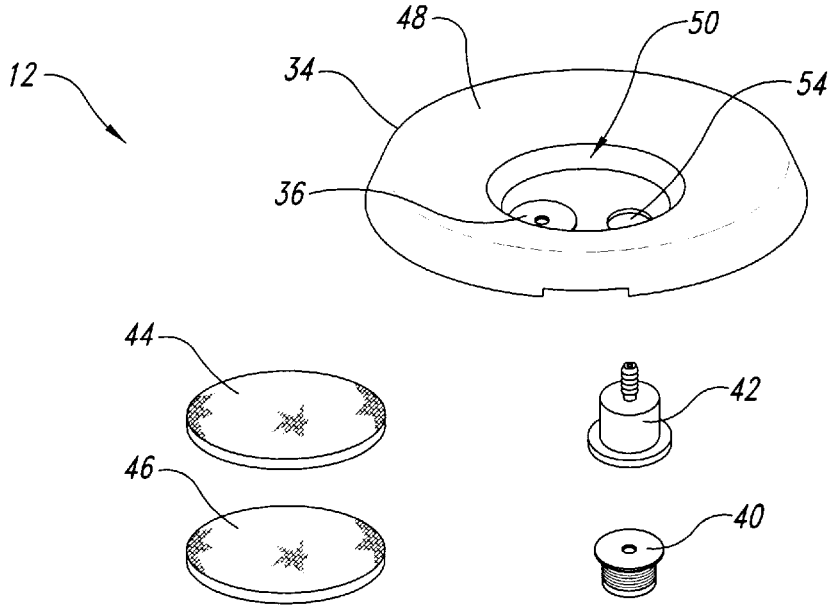
FIG. 3 is a front isometric view of the disassembled components of the hydro-massage pillow of FIG. 2.

Referring next to FIGS. 2 and 3, shown therein is the disassembled pillow assembly 12, which includes the body or pillow 34 itself, a first water jet head 36 and first water jet adaptor 38 attached to the pillow 34, a second water jet head 40 and second water jet adaptor 42 disassembled from the pillow 34, and a membrane assembly 44 also disassembled from the pillow 34. An optional second membrane assembly 46 is shown in FIGS. 2 and 3, which will be described in more detail hereinafter. The first water jet head 36 and adaptor 38 are identical to the second water jet head 40 and adaptor 42 and construction and use of both will be described in conjunction with the first water jet head 36 and adaptor 38.

Figure 4:
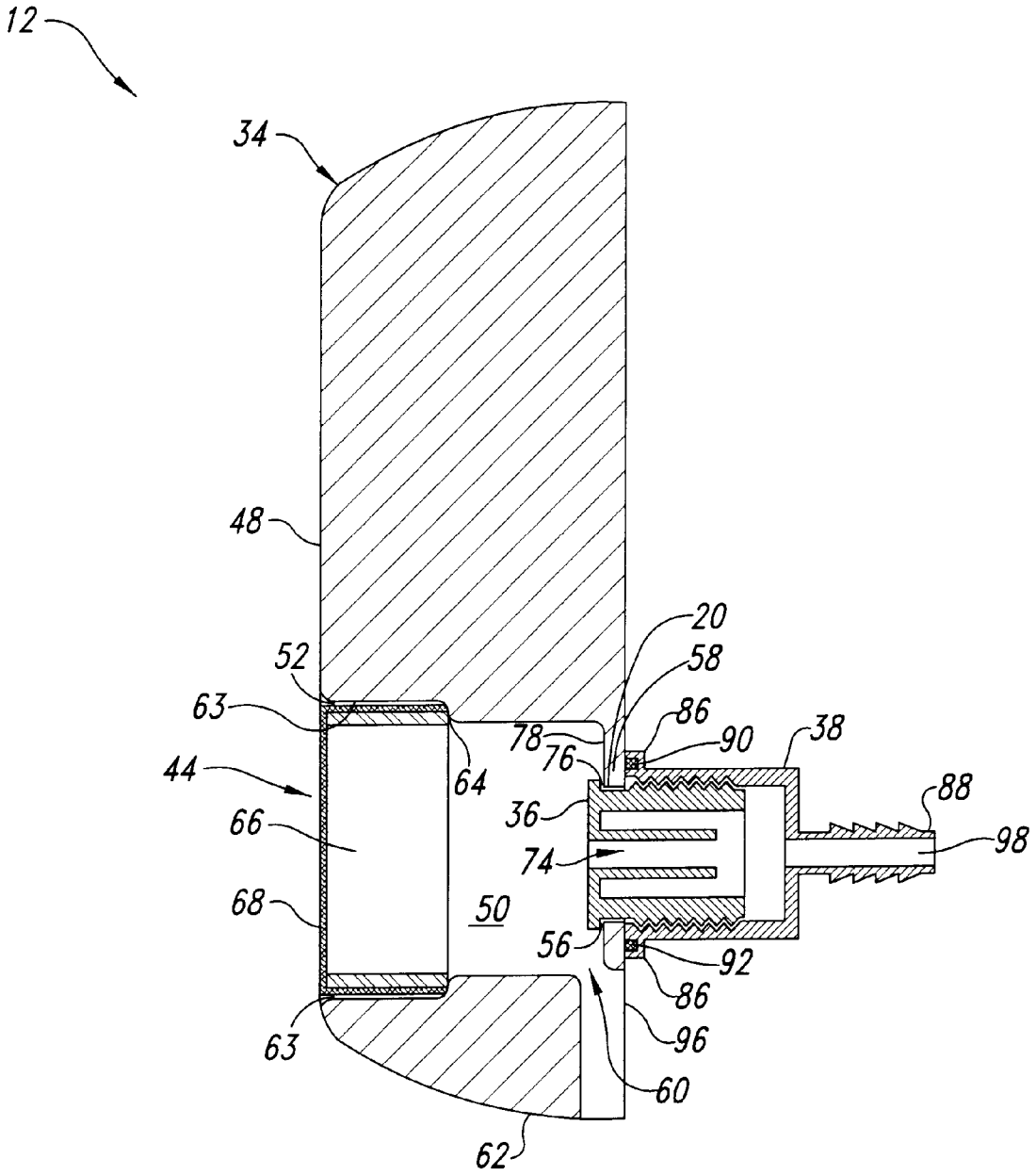
FIG. 4 is a cross sectional view of the assembled hydro-massage pillow taken along lines 4—4 of FIG. 1.

Referring next to FIGS. 2–4, the pillow 34 has a substantially oval plan form shape, as viewed from the front 48 of the pillow 34, and is ideally formed of flexible urethane material with cushioned portions formed around an oval-shaped cavity 50. The cavity 50 is formed near the lateral midpoint and slightly below the center of the pillow 34. A large front opening 52 is formed in the front 48 of the pillow 34, and two inlet openings 54 and 56 are formed in the back wall 58, which are in fluid communication with the cavity 50. A drain opening 60 is formed in the back wall 58 to drain water in the cavity 50 out through the bottom 62 of the pillow 34.

The front opening 52 of the cavity has a shoulder 64 formed almost halfway into the cavity 50, ideally adjacent the interior edge 63 that reduces the diameter of the cavity 50. The membrane assembly 44 is sized and shaped to be slidably received within the front opening 52 and to bear against the shoulder 64 with a tight, interference fit. Thus, the membrane assembly 44 cannot be pushed into the cavity, and the interference fit prevents pressurized water from forcing it out.

The membrane assembly 44 comprises an oval-shaped ring 66 sized and shaped to be received within the front opening 52 of the cavity as described above. Ideally, the ring is formed of resilient plastic material. A membrane 68 is stretched over and permanently attached to the ring 66 with suitable adhesive. Preferably, the membrane 68 is formed of semi-permeable two-way stretch material, such as the commercially available Lycra brand. The semi-permeability permits water under pressure to pass through the membrane 68 at a controlled rate without splashing. This type of material will maintain a taut condition during flexing of the urethane pillow 34, which can occur in use or when the pillow 34 is slightly bent upon mounting to a curved tub wall. The membrane assembly 44 can be removed from the pillow 34 for cleaning and washing of the membrane 68 and cleaning the other internal components of the cavity 50.

The pillow assembly 12 is designed for mounting to the wall of a tub 16, either with conventional fasteners, with hose fittings, or a combination thereof. Prior to attachment, holes are drilled in the tub end wall 30 for the fasteners and to permit the adapters 38, 42, to pass there through. The urethane pillow 34 will bend to conform to the curved shape of the tub end wall 30, enhancing appearance and comfort.

The removeability of the membrane assembly 44 permits an optional second membrane assembly 46 to be used. This second membrane assembly utilizes nonpermeable material for the membrane 70, which prevents the passage of water therethrough while facilitating the transfer of heat to the neck of the user as well as vibration from the impact of the water. Water is drained through the drain opening 60, or it can be drained through another hose, or a combination thereof.

Referring again to FIG. 4, the first water jet head 36 comprises a body 72 having a central longitudinal axial bore 74 formed therein for the passage of water. A circumscribing flange 76 is larger than the inlet opening 56 such that it bears against the interior surface 78 of the pillow back wall 58. A smooth neck portion 80 formed behind the flange 76 is sized and shaped to be slidably received within the inlet opening 56. Adjacent the neck portion 80 are external threads 82.

The first water jet adaptor 38 comprises a body 84 having a circumscribing external flange 86 at one end a reduced-diameter barbed hose nipple 88 at the other end. The external flange 86 includes a channel 90 formed therein with an O-ring seal 92 mounted therein. Internal threads 94 in the adaptor body 84 are sized and shaped to engage the external threads 82 on the water jet head 36. With the water jet head 36 and adaptor 38 attached together, the external flange 86 on the adaptor 38 forces the O-ring 92 into sealing contact with the external surface 96 of the back wall 58 to prevent the leakage of pressurized water.

The barbed hose nipple 88 is sized and shaped to receive one of the supply hoses 22, 24. Pressurized water is introduced to the cavity 50 through an opening 98 in the adaptor 38 and the axial bore 74 of the first water jet head 36. The drain opening 60 is sized and shaped to allow the pressurized water to drain or cascade out the pillow assembly 12. The size of the drain opening 60 may be varied to enable all o the water to drain as it is entering the cavity or to force the cavity to fill all or a portion of the cavity. Additional drainage is provided through the semipermeable membrane assembly 44. With the cavity 50 filled with water, pulses of water will be transmitted more uniformly throughout the membrane assembly 44.

Turning next to the control assembly 14, as shown in FIG. 1, the control assembly 14 includes a pair of control valves 100, 102 for controlling the flow of water to the pillow assembly 12. The water inlet hose 20 is connected via a T-fitting to the existing water jet pump associated with the tub 16. The water jet heads 36, 40 are small enough in size so as not to noticeably reduce or affect the existing water pressure.

The inlet hose 20 then connects to each control valve 100, 102, through conventional fittings, as will be known to one skilled in the art. The control valves 100, 102 may be conventional electric sprinkler control valves or other equivalent solenoid valves known to one skilled in the art and which are readily commercially available. The control head 26 is used to electrically control the operation of the valves 100, 102. The supply hoses 22, 24 are connected to and in fluid communication with the control valves 100, 102, respectively, and in turn are attached to the first and second water jet adapters 38, 42. The control valves 100, 102 may be operated through the control head 26 to have the water shut off, full on, or at various levels of flow in between. In addition, the valves 100, 102 may be operated to create a pulsing effect at the water jet heads 36, 40 and to alternate the pulsing effect of each water jet head 36, 48, to create alternating back and forth pulses of water.

It is to be understood that while a preferred embodiment of the invention has been illustrated and described, various changes may be made therein without departing from the spirit and scope of the invention. In one alternative embodiment, the pillow assembly 12 is connected directly to existing water jets in the tub 16, eliminating the use of the control assembly 14 and the control head 26. In this embodiment, the water supplied to the existing water jets in the tub 16 is used in the pillow assembly 12.

In another embodiment, the pillow assembly 12 may be separately encased inside an external membrane to facilitate transmission of the water pulses throughout the entire pillow assembly 12. This external membrane may be comprised of the same semi-permeable two-way stretch material as the membrane 68 described above, or it may consist of other material providing a similar effect.

The embodiments of the invention in which an exclusive property or privilege is claimed are defined as follows:

1. A hydro-massage pillow for use with a source of pressurized water, comprising:

a flexible, cushioned body having a cavity formed therein;

a first opening formed in one side of said body in fluid communication with said cavity for admitting pressurized water into said cavity;

a second opening formed in another side of said body in fluid communication with said cavity, the second opening having an interior edge;

a membrane sized to be received within and fill said second opening; and a mounting member configured to removably mount said membrane in said second opening, the mounting member comprising a resilient frame member having the membrane mounted thereon, the resilient frame member sized and shaped to be slidably received within and retained in the second opening by the interior edge.

2. The pillow of claim 1 wherein said interior edge slopes inwardly at a reducing diameter to a shoulder to provide a tight fit for the frame member and membrane and to hold the membrane coplanar with a front face of the flexible, cushioned body.

3. The pillow of claim 2 wherein said resilient frame member is sized and shaped to have a fit within said second opening of sufficient snugness that said frame member and said membrane maintain engagement with said body when pressurized water is applied in said cavity.

4. The pillow of claim 2 wherein said shoulder extending from the interior edge of said second opening is formed by a reduced-diameter portion of the cavity.

5. The pillow of claim 4 wherein said membrane is formed of semi-permeable material.

6. The pillow of claim 4 wherein said membrane is formed from nonpermeable material, and further wherein said body includes means for draining water from said cavity.

7. A hydro-massage support system for whirlpool baths and spa tubs, the system comprising:

a flexible, cushioned body having a cavity formed therein;

a first opening formed in said body in fluid communication with said cavity for admitting pressurized water into said cavity;

a second opening formed in said body in fluid communication with said cavity, the second opening having an interior edge and a shoulder extending from the interior edge;

a membrane sized and shaped to cover at least a portion of said second opening, said membrane being received within said second opening; and a resilient frame member on which said membrane is mounted, said resilient frame member being sized and shaped to be slidably engaged and retained within said second opening by the interior edge;

a control assembly for controlling the application of pressurized water to said body; and a remote controller in electrical communication with said control assembly.

8. The system of claim 7 wherein said interior edge slopes inwardly at a reducing diameter to the shoulder to provide a tight fit for the frame member and membrane and to hold the membrane coplanar with a front face of the flexible, cushioned body.

9. The system of claim 8 wherein said shoulder formed on the interior edge of said second opening is formed by a reduced-diameter portion of the cavity.

10. The system of claim 8 wherein said membrane is formed from semipermeable material.

11. The system of claim 8 wherein said membrane is formed from nonpermeable material, and further wherein said body includes means for draining said cavity.

* * * * *